United States Patent [19]

Crane et al.

[11] 4,047,415

[45] Sept. 13, 1977

[54] APPARATUS FOR SHAPING THE END OF A HOLLOW TUBE

[76] Inventors: Warren Joseph Crane, 161 Boden Lane; Russell Bancroft Collins, 17 Hillcrest Ave.; Charles Warren Crane, 161 Boden Lane, all of, Natick, Mass. 01760

[21] Appl. No.: 629,557

[22] Filed: Nov. 6, 1975

[51] Int. Cl.[2] ..... B21D 19/02

[52] U.S. Cl. ..... 72/125; 72/317

[58] Field of Search ..... 72/316, 317, 322, 125

[56] References Cited

U.S. PATENT DOCUMENTS

| | | | |
|---|---|---|---|
| 1,795,358 | 3/1931 | Arndt | 72/317 |
| 2,117,543 | 5/1938 | Corrigan | 72/317 |
| 2,242,831 | 5/1941 | McIntosh | 72/317 |
| 2,430,168 | 11/1947 | Graham | 72/317 |
| 3,575,033 | 3/1969 | Meyer, Jr. | 72/317 |

*Primary Examiner*—Othell M. Simpson

*Assistant Examiner*—Horace M. Culver

*Attorney, Agent, or Firm*—Dike, Bronstein, Roberts, Cushman & Pfund

[57] ABSTRACT

A forming tool comprising a rigid frame, clamping jaws on the frame for clamping a hollow tube with the end to be formed in a position of alignment with a forming head mounted on the frame for linear movement toward the end of the clamped tube and for rotation about the axis of the tube, said clamping jaws containing an opening for receiving the forming head as it is advanced into engagement with the tube, and said forming head containing a fustrum conical forming cavity for engagement with the end of the tube within which the end of the tube is wholly formed. A pilot is provided within the forming cavity for maintaining the concentricity of the tube and forming cavity during the forming operation. The entire surface of the forming head is coated with a non-electrolytically applied surface coating of nickel.

1 Claim, 8 Drawing Figures

APPARATUS FOR SHAPING THE END OF A HOLLOW TUBE

BACKGROUND OF INVENTION

In the automotive industry small diameter tubing is used for the braking system and the ends of the tubes which are connected to the master cylinder and to the brake cylinder are formed at the factory in a predetermined shape for mating with threaded coupling members. The tubes are generally made to a predetermined length to fit the particular vehicles with which they are to be used and if the vehicle is of foreign make the replacement of such a tube in the event that it fails may involve a considerably delay particularly if the failure occurs at a place where the replacement tubes are not available. It is the purpose of this invention to provide a very simple and efficient forming tool which will enable the ordinary garage and/or gas station attendant to replace such a custom made tube with high pressure tubing which is readily availabe but not in any particular length by forming the end or ends of the tube to the required shape on the spot and so eliminate any prolonged delay. Tools for flaring or forming the ends of the tubes are, of course, not new such tubes being shown in the U.S. Pats. to Corrigan, No. 2,117,543, Franck, No. 2,892,480 and Meyer, No. 3,575,033. None of these patents, however, is designed to form the end of a tube as required and, in particular, each of the devices shown in the aforesaid patents is somewhat complicated in construction, requires several operations to perform the forming operation, requires adjustment and substitution of parts during various steps of the forming operation which can be easily lost and which are expensive to manufacture. In contrast, the forming tool of this invention is so simple and inexpensive to manufacture as to be available to every garage and filling station mechanic both because it does not entail any considerable expense to purchase or maintain and does not require a skilled mechanic for its operation.

SUMMARY OF INVENTION

As herein illustrated the forming tool comprises a rigid frame, means for clamping the part to be formed in a predetermined position, a forming die supported in a position to be moved into engagement with the part to be formed, said forming die embodying a pilot for engagement with the part to center the die with respect to the part and a forming recess corresponding in configuration with the form to be imparted to the part within which the part is totally formed by linear and rotational movement of the forming die into compressive engagement with the clamped part and means for effecting linear and rotational movement of the forming die relative to the part.

The invention will now be described in greater detail with reference to the accompanying drawings wherein.

Figure 1:
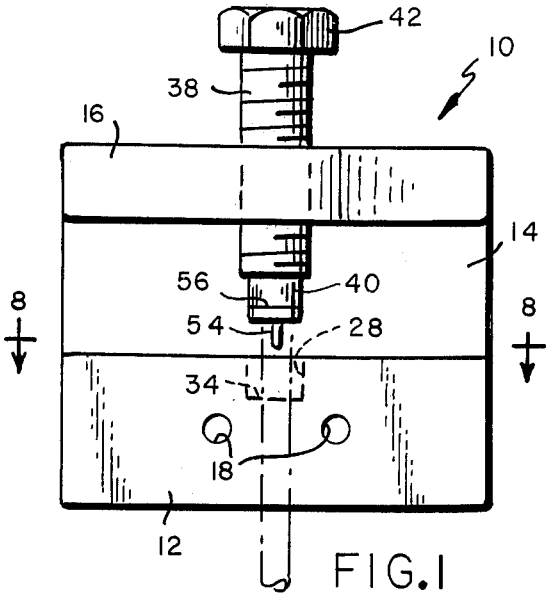
FIG. 1 is a front elevation of the forming tool.

As herein illustrated, the forming tool 10, comprises a rigid generally C-shaped frame having a base part 12, back part 14 which rises perpendicularly from the base part and a top part 16 which overlies and is parallel to the base part 12. The base part 12 contains horizontally disposed spaced parallel holes 18-18 for slidably receiving space rods 20-20 to which is fixed a block 22 which corresponds in thickness and length to the base part 12. At the forward face of the base part 12 there is a vertically extending groove 24 of semi-circular cross section and at the inner side of the block 22 there is a corresponding groove 26 of semi-circular cross section. The forward side of the base part 12 and the inner side of the block 22 are designed to be brought into clamping engagement by movement of the block 22 toward the base part 12 to clamp a work piece to be operated on in the grooves 24 and 26 which constitute clamping jaws. Clamping of the block 22 against the base part 12 may be provided for, for example, by placing the tool between the jaws of a bench press or vice.

Figure 8:
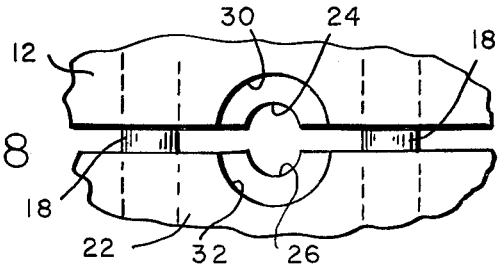
FIG. 8 is a fragmentary plan view taken on the line 8—8 of FIG. 1 with the clamping jaws separated.

An opening 28 concentric with the axis of the opening provided by the grooves 24 and 26 is provided at the upper side of the base part and block by semi-circular recesses 30 and 32, FIG. 8, formed in the forward face of the base part 12 and the inner face of the block 22, and the bottom 34 of which limits the movement of the forming die as will be described hereinafter.

Figure 4:
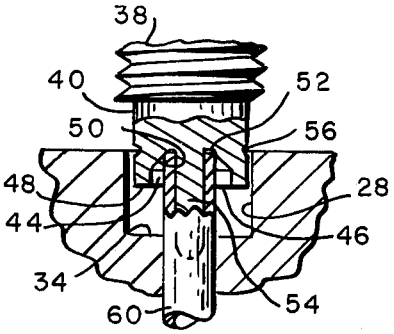
FIG. 4 is a fragmentary section showing the initial position of the forming tube prior to commencing the forming operation.
Figure 5:
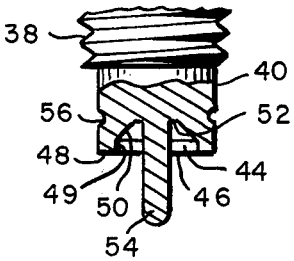
FIG. 5 is a fragmentary section showing an intermediate position of the forming tube.
Figure 6:
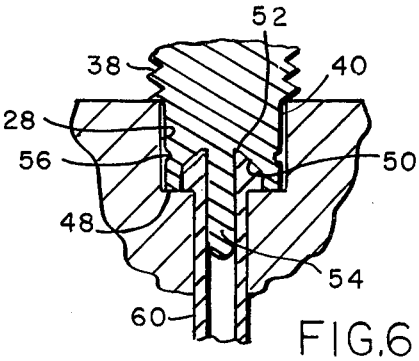
FIG. 6 is a fragmentary section showing the final position of the forming tube.

The top part 16 contains a vertically disposed threaded opening 36, the axis of which coincides with the axis of the opening 28 and the hole provided by the grooves 24 and 26. A bolt 38 is threaded into the opening 36 which has at its lower end a forming die 40 and at its upper end an operating head 42 to which a wrench or other clamping device may be applied for effecting rotation of the bolt. The forming die 40 is fixed to the lower end of the bolt 38 so that rotation of the bolt not only advances the forming die linearly towards the jaws between which the work piece is clamped but also effects rotation of the forming die. The forming die as shown in FIGS. 4, 5 and 6 corresponds in outside diameter to the inside diameter of the opening 28 so that as the bolt is rotated the forming die slidingly and rotationally enters the opening 28. At the leading end of the forming die there is a forming cavity 44 which is of smaller diameter at its entrance than the outside diameter of the die so that there is an annular flat 48 peripherally of the cavity. The entrance to the cavity has a right cylindrical surface 49 of predetermined length and inwardly thereof there is a conical surface 50 which terminates at its inner end in a flat annular surface 52 which is perpendicular to the axis of the die. At the center of the flat annular surface 52 there is an axially extending pilot 54 the diameter of which corresponds substantially to the inside diameter of the hollow tube which is to be shaped. Exteriorly of the forming die there is a circular gauge mark 56 spaced from the leading end of the die a predetermined distance.

Figure 2:
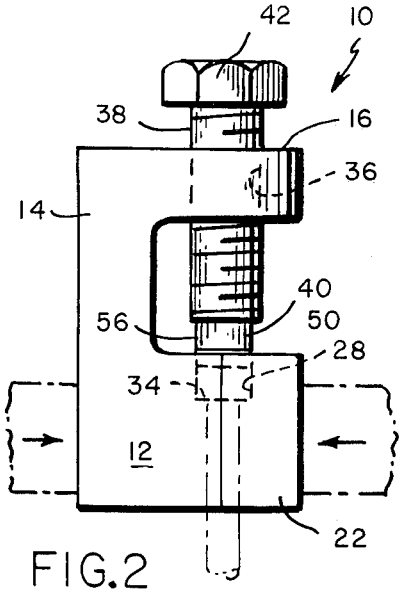
FIG. 2 is a side elevation as seen from the left side of FIG. 1.
Figure 3:
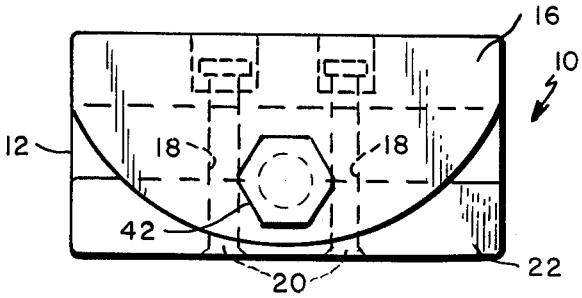
FIG. 3 is a top view of FIG. 1.
Figure 7:
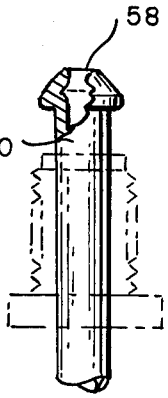
FIG. 7 is an elevation of the hollow tube having a head formed at one end with the forming tool of this invention and with a threaded coupling thereon.

The tool as thus described is designed to form a substantially frusto conical head 58 at one end of a hollow tube 60 as shown in FIG. 7. This is accomplished by first pulling the block 22 away from the base part 12, FIG. 8, inserting the hollow tube 60 between the parts and then moving them together to clamp the tube between them with the end which is to be shaped projecting upwardly from the base part 12 and block 22 into the space beneath the forming die 40, FIG. 2. The length of projection of the tube prior to commencement of the forming operation is determined by screwing the bolt 38 downwardly until the gauge mark 56 coincides with the upper surface of the bottom part 12 and block 22, FIG. 2, and then clamping the tube at this position. Following clamping the screw 38 is rotated to move the forming die 40 linearly into the opening 28 against the projecting end of the tube and simultaneously rotating it relative to the tube about the axis thereof. Engagement of the forming die within the hole 28 guides and rigidly maintains it in exact axial relation to the tube and entrance of the pilot 54 into the tube prevents eccentric displacement of the walls of the tube. As the forming die continues toward the bottom of the opening 28 the conical surface 50 crowds the wall at the leading end of the tube inwardly along its surface and against the horizontal surface 52 so as to form the desired frustro conical portion of the head 58, flattens the edge about the opening and displaces the wall at the base of the frustro conical portion laterally to form the cylindrical portion and the rounded shoulder. The pilot 54 maintains the opening at the end centered with respect to the axis of the tube. The forming die is moved all the way to the bottom 34 of the opening 28 as it approaches the bottom and the radially underside of the head is formed perpendicular to the axis of the tube. The bottom 34 is not necessarily perpendicular to the axis of the opening.

As previously stated, the forming die is moved both axially and rotationally in engagement with the end of the tube as the forming operation proceeds and in accordance with this invention the entire forming operation takes place in a single sustained displacement of the metal of the tube from the beginning of the forming operation until the end of the forming operation so that the metal in the tube is subjected to the minimum amount of hardening during the forming operation thus eliminating any necessity for a subsequent heat treatment or annealing to restore the original characteristics of the metal of the tube. It is desirable during the forming operation to effect burnishing of the end of the tube and also to reduce the amount of frictional resistance to rotation of the forming die as it is advanced linearly against the end of the tube and thereby also reduce any twisting of the tube and to this end the forming die is plated with nickel which is non-electrolytically applied. The plating is applied to the exterior surface of the forming die and to the interior surface of the forming recess.

The tool is especially designed to form the ends of small diameter tubing such as is manufactured by ITT known as terne steel tubing annealed which is relatively ductile and can be easily bent to accommodate the installation without collapse of the walls.

The forming tool as thus constructed is very simple and compact in design, inexpensive to manufacture and can be used to form the head on a hollow tube without requiring a skilled operator.

It should be understood that the present disclosure is for the purpose of illustration only and includes all modifications or improvements which fall within the scope of the appended claims.

We claim:

1. A tool for forming a head at one end of a hollow tube made of a deformable material, said tool comprising an anvil containing a cylindrical opening of predetermined diameter greater than the diameter of the head to be formed at the end of the tube, means for clamping the tube with the end to be formed into a head extending into said opening in concentric relation thereto, a die supported in axial alignment with the cylindrical opening in the anvil for rotation and rectilinear movement toward the cylindrical opening, a cylindrical tip at the leading end of the die, interengageable within the cylindrical opening by movement of the die toward the cylindrical opening, said cylindrical opening having a predetermined depth and having at its bottom a flat annular surface at right angles to the axis of the cylindrical opening, and said cylindrical tip having a flat end surface at right angles to the axis of the die for engagement with the flat annular surface at the bottom of the cylindrical opening and containing at said end an axially extending cylindrical pilot member of a diameter corresponding to the inside diameter of the tube for reception within the tube as the die is advanced into the cylindrical opening, and surrounding said pilot member an annular opening comprising an axially extending cylindrical portion at the end face, inwardly of the cylindrical portion a frustoconical portion and at the inner end of the frustoconical portion an annular portion, screw means mounting the die for movement toward the cylindrical opening in the anvil to force the cylindrical tip into the cylindrical opening into engagement with the end of the tube and by a combination of rotation and rectilinear movement, reform the metal of the wall while the latter is supported internally by the pilot member so as to cause the metal of the wall of the tube to conform in solid section to the annular space surrounding the pilot member.

* * * * *